United States Patent [19]

Born

[11] 4,328,609

[45] May 11, 1982

[54] MACHINE FOR CUTTING AND REMOVING CORD OR BAND FROM SECURED GOODS

[76] Inventor: Peter Born, Reutenstrasse 15, CH-4800, Zofingen, Switzerland

[21] Appl. No.: 209,106

[22] PCT Filed: Jan. 25, 1979

[86] PCT No.: PCT/CH79/00008

§ 371 Date: Nov. 2, 1979

§ 102(e) Date: Oct. 18, 1979

[87] PCT Pub. No.: WO79/00682

PCT Pub. Date: Sep. 20, 1979

[30] Foreign Application Priority Data

Mar. 2, 1978 [CH] Switzerland ..... 2241/78

[51] Int. Cl.[3] ..... B65B 69/00

[52] U.S. Cl. ..... 29/564.3; 83/100; 83/909

[58] Field of Search ..... 29/564.3; 53/381 R, 53/372; 83/100, 909, 924; 30/128

[56] References Cited

U.S. PATENT DOCUMENTS 2,820,282 1/1958 Schneider, Jr. ..... 29/564.3

3,513,522 5/1970 Thompson ..... 83/909 X 3,599,328 8/1971 Ursetta ..... 30/128

3,750,504 8/1973 Sidler ..... 83/100 X 3,926,322 12/1975 Scott ..... 53/381 R X

FOREIGN PATENT DOCUMENTS 363647 2/1973 U.S.S.R. ..... 83/924

*Primary Examiner*—Z. R. Bilinsky

*Attorney, Agent, or Firm*—Saul Jecies

[57] ABSTRACT

A machine for cutting and removing cord or band from secured goods, having a portal stand to which a conveyer brings the goods secured by cord or band. A cross beam can be vertically adjusted and guided along uprights and suspended from two rope lines which are run over fixed pulleys and connected with a pulley block that is actively connected to a gear brake motor. To one end section of the cross beam is mounted an adjustable cutter unit and to the other an adjustable suction unit. Both units have each one spring-mounted movable feeler plate. To the feeler plate of the cutter unit is mounted a vertically positioned cutter head and to the feeler plate of the suction unit is connected a suction head that removes the cut securing agents.

4 Claims, 4 Drawing Figures

MACHINE FOR CUTTING AND REMOVING CORD OR BAND FROM SECURED GOODS

The invention concerns a machine for cutting and removing cord or band from secured goods, with a portal stand and a conveyer leading through the latter.

According to regulations, the top goods piled on pallets must be held together by means of a binding agent (cord or band) applied in the horizontal plane. The binding agent is removed after the shipping process has been concluded.

We know the rod cutter used by the pallet lift truck driver to cut the cord or band with which the goods are tied together. This is laborious and troublesome work. Also inconveniencing are the cut binding agents and the carrying along of the cutter.

These drawbacks will be eliminated with the machine according to the invention.

The drawings show, as an example, an embodiment of the machine object of the invention.

Figure 1:
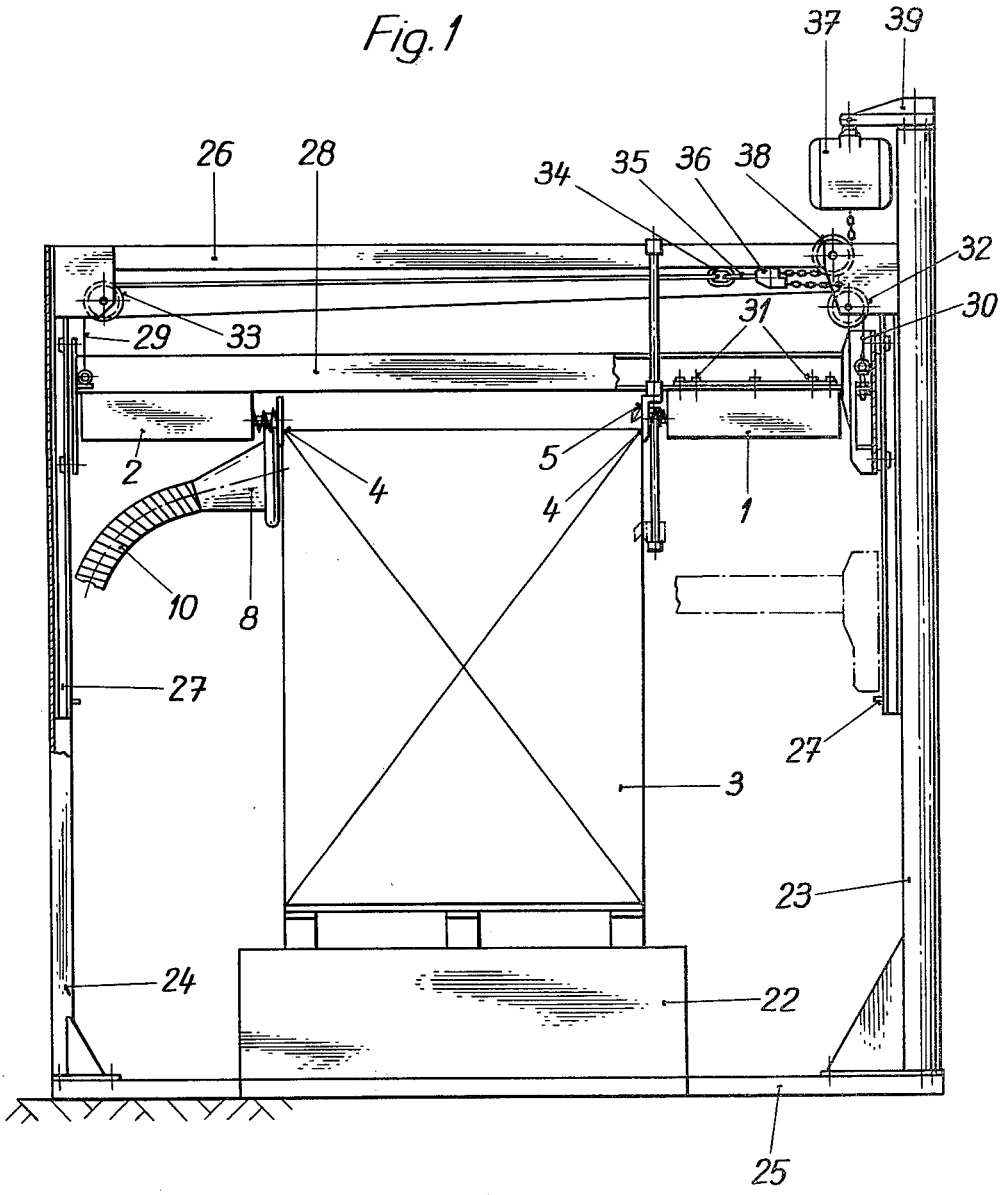
FIG. 1 is a view of the machine.

The machine presented here includes a portal stand to which a conveyer 22 brings the goods 3 (FIG. 1) secured by a cord or a band. This portal stand is formed by one bottom cross girder 25, one top cross girder 26 and two uprights 23, 24. One upright 23 is higher and provided on top with a bracket 39 whereto is secured a chain block 37 fitted with a gear brake motor. It serves to effect parallel vertical adjustment of a cross beam 28 provided with roller guides 27 at both uprights 23, 24. The cross beam 28 is suspended at one end from a rope line 29 and on the other from a rope line 30. The rope line 29 is turned around a fixed rope pulley 33 and connected to an eye 34 of a load hook 35 of a block 36 guided horizontally by a pulley 38. The other rope line 30 is turned around the two fixed pulleys 32 and 33 and also attached to the eye 34. Pulley block 36 is connected with the chain of chain block 37 and the vertical adjustment of cross beam 28 can be effected by manual control or by automated scanning and made to fit the respective height of the top goods 3 tied up.

To the bottom side of one end section of the cross beam 28 is mounted a cutter unit 1 and, of the other end section, a suction unit 2 in the longitudinal direction of cross beam 28, by means of detachable clamp connections 31.

Figure 2:
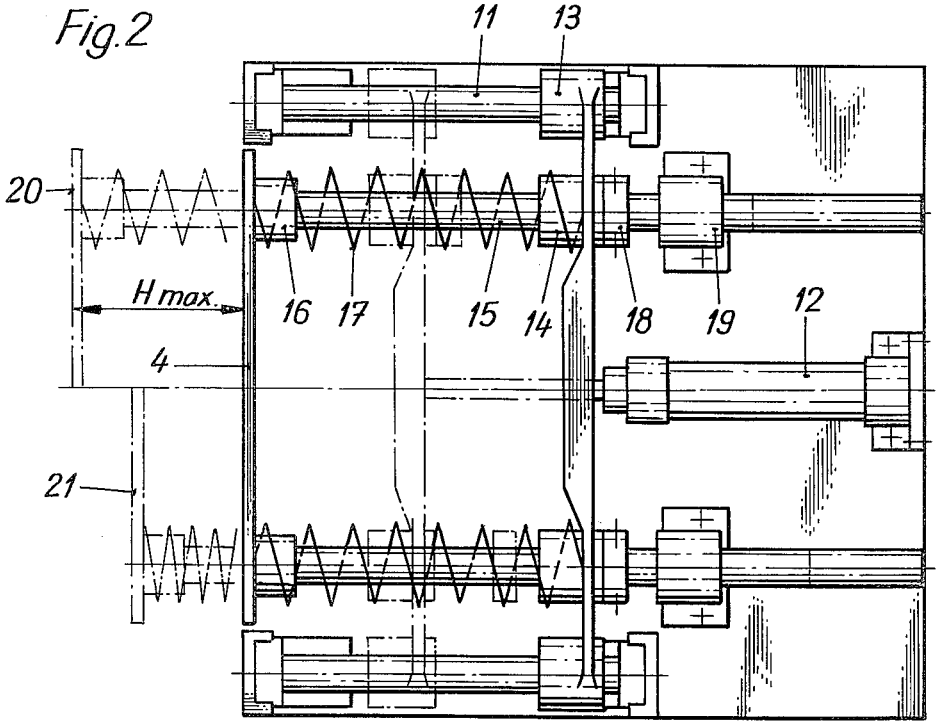
FIG. 2 is a plan view of the feeler plate control system.

Both units 1, 2 display each one plate to which two guide rods 11 are attached (FIG. 2). They serve to guide the adjustable cross girder 13 controlled by means of a lifting drive 12. In two longitudinal bearings 19 attached to the plate are held two movable push and pull rods 15 which are led, in addition, through one hub 14 each of cross girder 13 with longitudinal bearings. Both rods 15 are secured at their outer end to lugs 16 of a feeler plate 4. Springs 17 are resting against cross girders 13 and serve to push the feeler plate 4 forward with the desired strength. The foremost position of feeler plate 4 is limited by stops 18. Feeler plate 4 can be moved to maximum position 20 ($H_{max}$). Upon contact with the goods 3, the feeler plate 4 will remain set in position 21.

Figure 3:
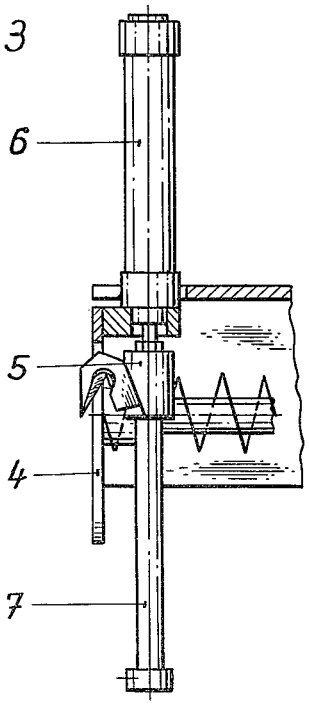
FIG. 3 shows a feeler plate with a blade actuating system.

Two vertical guide rods 7 (FIG. 3) are attached to the feeler plate of the cutter unit 1. These rods hold a blade head 5 made movable by a lifting drive 6. The blade projects through a slot of feeler plate 4 and minimum by the thickness of the binding agent (cord or band) so that the cord or band can be caught by the cutting edge of the blade.

Figure 4:
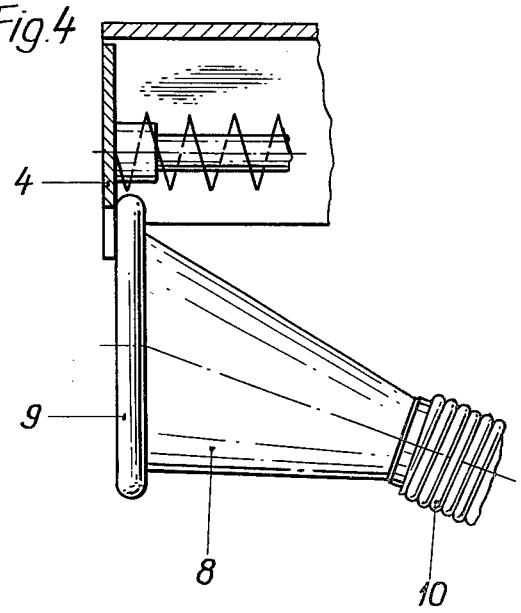
FIG. 4 shows a feeler plate with attached suction head.

Onto the feeler plate 4 of the suction unit 2 is installed a funnel-shaped suction head 8 with the suction intake 9 positioned in the area of the cut binding agent (FIG. 4). Suction head 8 is connected to a suction hose 10 that leads into a vacuum container that acts as a separator and that is connected to a suction blower (not shown here).

I claim:

1. A machine for cutting and removing cord or band extending in a plane and surrounding a number of discrete packages placed on a pallet extending in a place substantially parallel to that cord or band, comprising a portal stand;

a vertically adjustable horizontal cross beam connected to said portal;

adjusting means for adjusting the vertical position of that cross beam;

conveyor means carrying said pallet through that portal stand;

cutter means for cutting said cord adjustably carried by said cross beam;

a feeler device attached to that cutter means;

biasing means biasing said feeler device toward the center of that cross beam;

a suction device adjustably carried by said cross beam spaced from said cutter means for automatically sucking in and removing said cut pieces of cord or band;

a second feeler device attached to said suction device; and a second biasing means biasing said second feeler device towards said center of said cross beam.

2. A machine as claimed in claim 1, comprising first motor means; and rope means connected on one end to said motor means and connected on the other end to said horizontal cross beam for vertically adjusting said cross beam.

3. A machine as claimed in claim 1, comprising guide means for guiding said cutter means and said suction device towards each other parallel to said cross beam.

4. A machine as claimed in claim 1, said suction device comprising a funnel shaped suction head attached to said suction device for sucking in and removing the cut cord or band ends from the machine.

* * * * *